US007992237B2

(12) United States Patent
Minning et al.

(10) Patent No.: US 7,992,237 B2
(45) Date of Patent: Aug. 9, 2011

(54) APPARATUS WITH PATIENT ADJUSTMENT DEVICE COUPLED TO ARCHITECTURAL SYSTEM

(75) Inventors: David M. Minning, Cincinnati, IN (US); Troy D. Action, St. Paul, IN (US); Jon C. Tekulve, Milan, IN (US); Christian H. Reinke, York, SC (US); Robert Mark Zerhusen, Cincinnati, OH (US); David C. Newkirk, Lawrenceburg, IN (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 12/789,990

(22) Filed: May 28, 2010

(65) Prior Publication Data

US 2010/0293711 A1 Nov. 25, 2010

Related U.S. Application Data

(62) Division of application No. 11/209,867, filed on Aug. 23, 2005, now Pat. No. 7,725,964.

(60) Provisional application No. 60/605,039, filed on Aug. 27, 2004.

(51) Int. Cl.
*A61G 7/08* (2006.01)

(52) U.S. Cl. ..... 5/81.1 HS; 5/81.1 R

(58) Field of Classification Search ..... 5/81.1 R, 5/600, 83.1, 658, 85.1, 87.1–89.1, 81.1 HS, 5/503.1; 52/36.4
See application file for complete search history.

(56) References Cited

U.S. PATENT DOCUMENTS

| | | | | |
|---|---|---|---|---|
| 4,726,082 | A * | 2/1988 | DiMatteo et al. | 5/81.1 C |
| 4,796,313 | A * | 1/1989 | DiMatteo et al. | 5/81.1 C |
| 6,058,533 | A * | 5/2000 | Nelson | 5/610 |
| 7,725,964 | B2 * | 6/2010 | Minning et al. | 5/81.1 R |
| 2006/0053698 | A1 * | 3/2006 | Minning et al. | 52/36.4 |
| 2010/0293711 | A1 * | 11/2010 | Minning et al. | 5/81.1 HS |

* cited by examiner

*Primary Examiner* — Robert G Santos
(74) *Attorney, Agent, or Firm* — Jason Penninger

(57) ABSTRACT

An apparatus comprises an architectural system and a patient adjustment device. The patient adjustment device is coupled to the architectural system and adapted to pull on a patient receiver to move a patient received by the patient receiver and located on a bed relative to the bed to adjust the position of the patient.

20 Claims, 10 Drawing Sheets

APPARATUS WITH PATIENT ADJUSTMENT DEVICE COUPLED TO ARCHITECTURAL SYSTEM

This Application is a divisional of U.S. patent application Ser. No. 11/209,867 titled APPARATUS WITH PATIENT ADJUSTMENT DEVICE COUPLED TO ARCHITECTURAL SYSTEM filed on Aug. 23, 2005, which claims the benefit under 35 U.S.C. §119(e) of Provisional Application No. 60/605,039 which was filed Aug. 27, 2004. The contents of both are incorporated herein by reference.

FIELD OF THE INVENTION

The invention relates to systems which assist with the movement of patients who may be partly or completely incapacitated.

BACKGROUND OF THE INVENTION

From time to time, patients who may be partly or completely incapacitated may need to be moved for a variety of reasons. For example, in some cases, a patient on a bed may have slid down, slumped, or otherwise moved toward a foot end of the bed due to inclination of a head section of the bed and may need to be moved back toward the head end after the head section is lowered. In other cases, a patient may need to be moved to a different bed.

SUMMARY OF THE INVENTION

The present invention comprises one or more of the features recited in the appended claims or the following features or combinations thereof:

An apparatus comprises an architectural system and a patient adjustment device. The patient adjustment device is coupled to the architectural system and adapted to pull on a patient receiver (e.g., a bed sheet, a draw sheet, a bed spread, a pad, patient clothing, patient harness, or other rollable material) to move a patient received by the patient receiver and located on a bed relative to the bed to adjust the position of the patient. The patient adjustment device may be used for a variety of purposes such as, for example, to move a patient who has slid, slumped, or otherwise moved away from a head end of the bed back toward the head end and to move a patient from one bed to an adjacent bed.

The architectural system may be mounted in a room of a care facility such as, for example, a hospital, a nursing home, and a home care program, to name a few. The architectural system may be adapted to couple to a wall, floor, or ceiling of the room.

The patient adjustment device may comprise a gripper to grip the patient receiver, a tether coupled to the gripper, and a power unit. The power unit is coupled to the tether to wind the tether to move the gripper and the patient received by the patient receiver gripped by the gripper.

The architectural system may comprise a column coupled to a wall of the room. The column extends between the ceiling and floor of the room. The power unit may be positioned in the column or in a bed locator extending from the column along the floor for locating the bed in the room adjacent the column. A vertically movable tether height adjuster may be positioned in the column to adjust the height at which the tether exits the column to thereby accommodate the height of the bed. In some embodiments, the column may be spaced from the wall and the bed locator may be spaced from the floor.

The architectural system may comprise a headwall coupled to the room wall. A device mount to which the patient adjustment device is coupled may be coupled to the headwall. The device mount may comprise a telescopic arm assembly coupled to the headwall for pivotable movement relative to the headwall. The power unit may be coupled to the telescopic arm assembly for pivotable movement therewith.

The architectural system may comprise a bed locator to locate the bed in the room. The patient adjustment device may be coupled to the bed locator. The bed locator may comprise a base coupled to the floor and a tether height adjuster. The power unit may be coupled to the base and the tether to wind the tether. The tether height adjuster may be coupled to the base for vertical movement relative to the base to adjust the height at which the tether extends away from the tether height adjuster to the gripper. The base may comprise a pair of arms. The tether height adjuster may be positioned between the arms in a curved track provided by the arms for vertical movement of the tether height adjuster along the track.

The architectural system may comprise a base coupled to the floor and a bed locator coupled to the base for locating the bed in the room. The power unit may be coupled to the base. The tether may extend upwardly from the power unit through a tether height adjuster to exit the tether height adjuster through an aperture formed therein. The tether height adjuster may be vertically movable in a track provided by upwardly extending arms of the base to adjust the height at which the tether exits the adjuster aperture to thereby accommodate the height of the bed.

The architectural system may be suspended from the ceiling as an articulating column system. The architectural system may comprise a horizontal first telescopic arm assembly coupled to the ceiling for pivotable movement relative to the ceiling. A vertical second telescopic arm assembly may depend from the first telescopic arm assembly to adjust the height of a device mount to which the power unit is coupled.

The architectural system may be coupled to the room wall for horizontal movement of the patient adjustment device along the wall. To facilitate such horizontal movement, the architectural system may comprise a mount support and a device mount coupled to the patient adjustment device and the mount support for horizontal movement of the device mount and the patient adjustment device coupled thereto along the mount support. Illustratively, the mount support comprises a pair of horizontal, parallel rails coupled to the wall, and the device mount comprises a housing containing the power unit and a plurality of rollers coupled to the housing and rollable along the rails.

The architectural system may be coupled to the room wall for vertical movement of the patient adjustment device along the wall. To facilitate such vertical movement, the architectural system may comprise a mount support and a device mount coupled to the patient adjustment device and the mount support for vertical movement of the device mount and the patient adjustment device coupled thereto along the mount support. In some cases, the mount support may comprise a wall portion coupled to the wall, a ceiling portion coupled to the ceiling, and a slot formed in the wall portion and the ceiling portion to extend vertically along the wall portion and to extend along the ceiling portion in a direction having a horizontal component. The mount device may be arranged to move the power unit therewith along the slot. In other cases, the mount support may comprise a vertical track, and the mount may comprise a track follower for following the vertical track. A pivot arm may be coupled to the track follower and the power unit for vertical movement of the pivot arm and the power unit with the track follower along the track. The pivot arm may be pivotable relative to the track follower to adjust the height of the patient adjustment device.

The architectural system may be coupled to the ceiling for horizontal movement of the patient adjustment device along the ceiling. A tether direction adjuster may be coupled to the wall to change the direction of extension of the tether from a generally vertical direction to a generally horizontal direction to facilitate horizontal movement of the patient by the patient adjustment device.

The architectural system may be positionable in and out of a cavity formed in a headwall. The patient adjustment device may be coupled to the architectural system for movement therewith in and out of the cavity. The architectural system may be generally L-shaped so as to comprise a generally horizontal wheeled base and a generally vertical portion that extends upwardly therefrom and that is configured to be received in the cavity. The power unit may be coupled to the base or the vertical portion. The tether may extend from the vertical portion to the gripper.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION OF THE DRAWINGS

Figure 1:
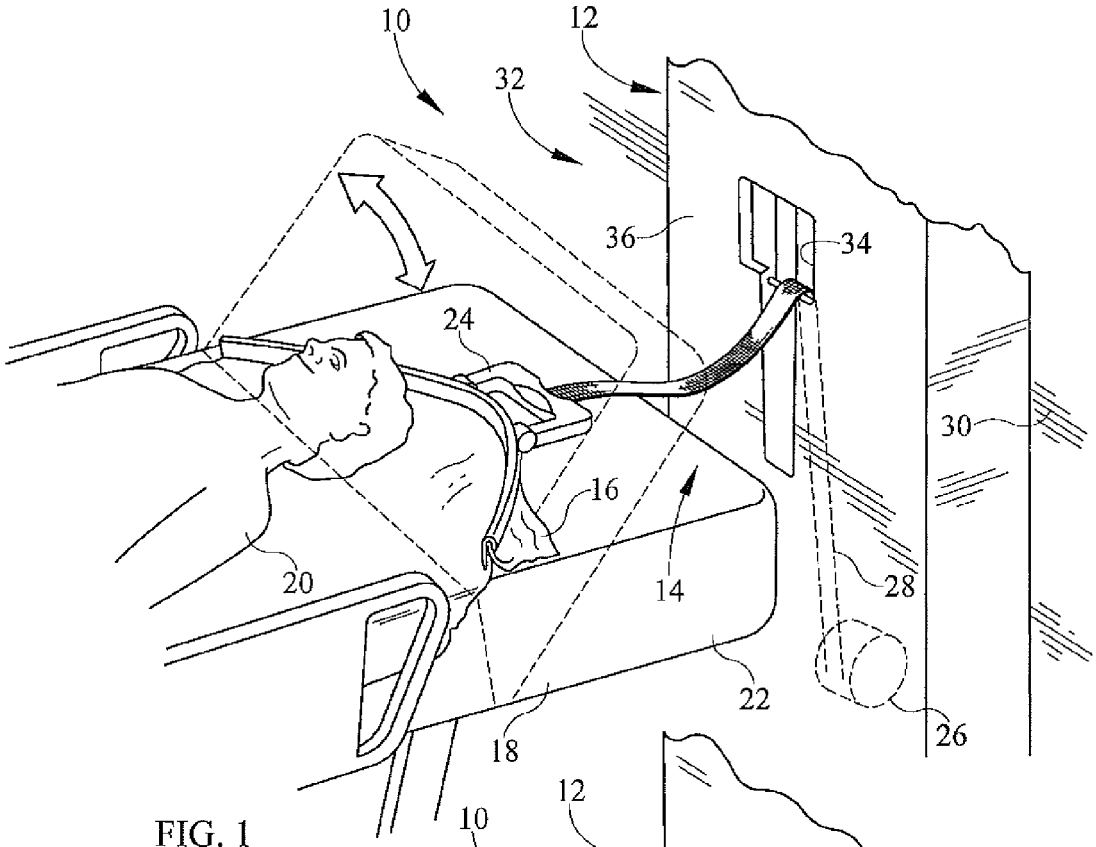
FIGS. 1 and 2 are perspective views showing movement of a patient toward a head end of a bed by use of a patient adjustment device which is coupled to a column coupled to a wall of a room.
Figure 2:
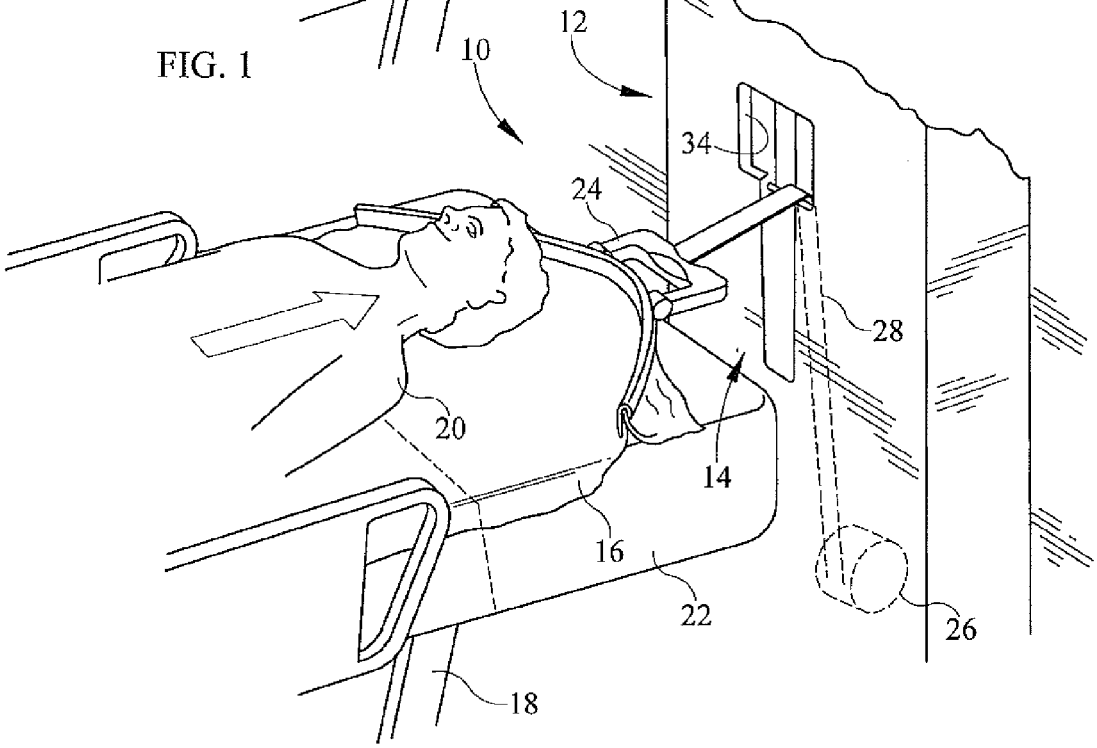

Referring to FIGS. 1 and 2, an apparatus 10 comprises an architectural system 12 and a patient adjustment device 14. Device 14 is coupled to system 12 and adapted to pull on a patient receiver 16 to move a patient 20 received by patient receiver 16 and located on a bed 18 relative to bed 18 to adjust the position of patient 20. Device 14 may be used, for example, to move patient 20 horizontally back toward a head end 22 of bed 18 in the event that patient 20 slides down away from head end 22 due to inclination of head end 22, as shown, for example, in FIGS. 1 and 2.

Patient adjustment device 14 comprises a gripper 24 for gripping receiver 16, a power unit 26, and a tether 28 connecting gripper 24 and power unit 26. Details of a suitable gripper are shown in PCT Application No. PCT/US03/18875 which is incorporated by reference herein. Illustratively, power unit 26 is configured as a winch to wind tether 28 to cause gripper 24 to pull on receiver 16 to move patient 20 relative to bed 18. Power unit 26 is also configured to allow tether 28 to be unwound for extension of gripper 26 to the location of receiver 16. An example of power unit 26 comprises a spool for receiving tether 28 and an electric motor for rotating the spool to wind and/or unwind tether 28. It is within the scope of this disclosure for power unit 26 to be any device which operates to pull on tether 28. User controls (not shown) may be used to control operation of power unit 26.

It is within the scope of this disclosure for patient receiver 16 to be, for example, a bed sheet, a draw sheet, a bed spread, a pad, patient clothing, patient harness, or other grippable material that can be gripped by gripper 24. Illustratively, patient receiver 16 is a sheet located on bed 18. In such a case, device 14 is adapted to pull on the sheet to move patient 20 located on the sheet relative to bed 18 to adjust the position of patient 20. Gripper 24 may include a roller, hook(s), snap(s), fastener(s), or other coupler(s) couple to receiver 16.

Architectural system 12 comprises a column 36 coupled to a wall 30 of a room 32. Power unit 26 is positioned in and mounted to column 36. Tether 28 extends from power unit 26 through an aperture 34 formed in column 36 to gripper 26 for movement through aperture 30 upon winding and unwinding of tether 28. Column 36 may extend all the way between a floor of room 32 and a ceiling of room 32, down from the ceiling without reaching the floor, or up from the floor without reaching the ceiling. Column 36 may be coupled to wall 30 without reaching either the floor or ceiling. In alternative embodiments, column 36 may be spaced from wall 30 of room 32.

Figure 3:
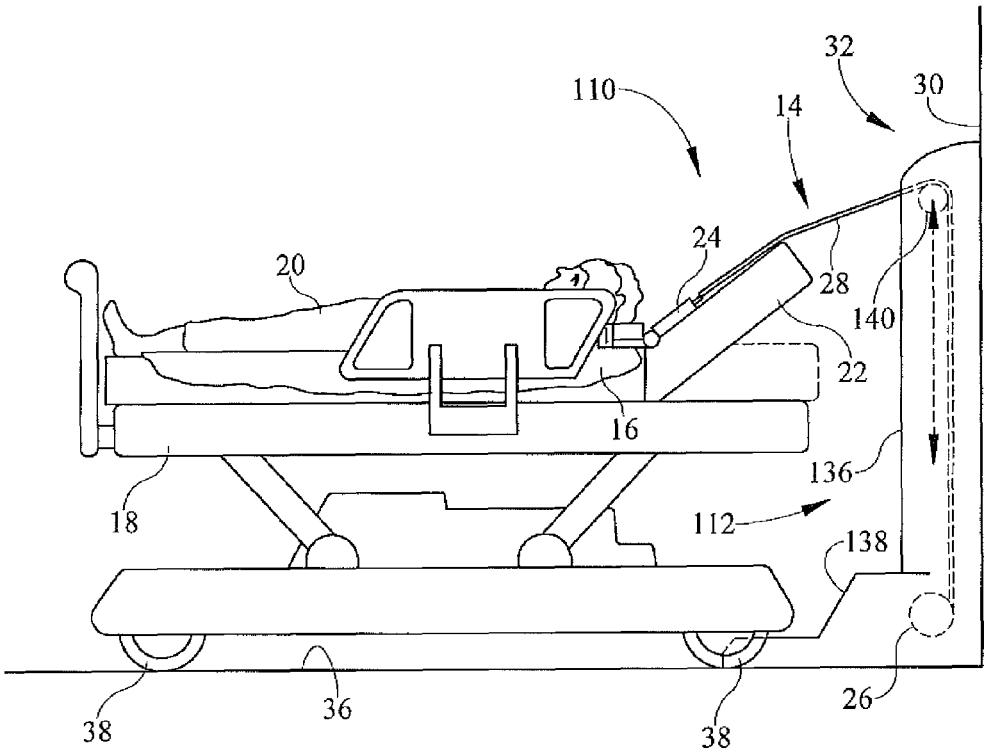
FIGS. 3 and 4 are elevational views showing use of a tether height adjuster to adjust the height at which a tether of the patient adjustment device exits a column to accommodate the height of a bed on which a patient is located and showing a power unit for winding the tether positioned in a bed locator extending from the column along a floor.
Figure 4:
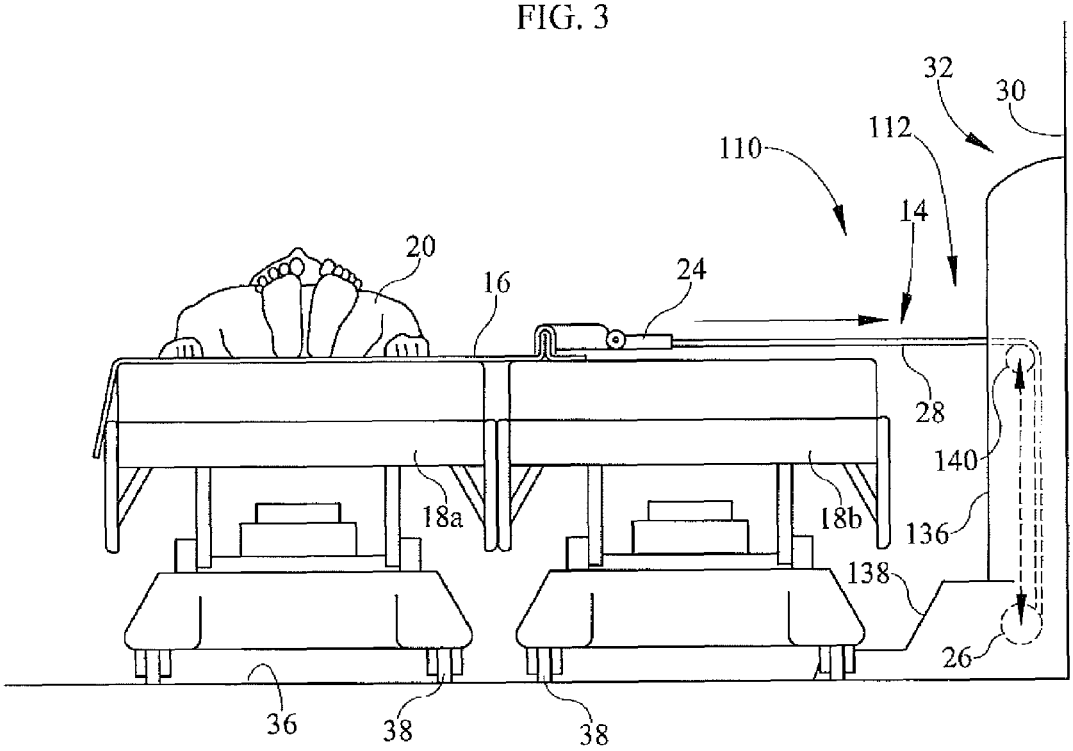

Referring to FIGS. 3 and 4, an apparatus 110 comprises an architectural system 112 and patient adjustment device 14 which is coupled to system 112. System 112 comprises a column 136 coupled to wall 30, a bed locator 138 coupled to column 136 and a floor 36 of room 32 for locating bed 18 in room 32 adjacent to column 136, and a tether height adjuster 140. Power unit 26 is positioned in and mounted to bed locator 138. Tether 28 extends upwardly from power unit 26 to height adjuster 140 where it turns to extend generally horizontally in FIG. 4 and at an acute angle in FIG. 3 to gripper 24 through a vertical slot (not shown) formed in column 136.

Height adjuster 140 is configured to adjust the height at which tether 28 exits column 136 through the slot formed therein to thereby accommodate the height of bed 18. To do so, height adjuster 140 is configured for vertical movement relative to column 136 to assume a selected one of a plurality of vertically-spaced positions such as an upper position shown, for example, in FIG. 3 and a lower position, shown, for example, in FIG. 4. The upper position is useful in a variety of situations including the situation shown in FIG. 3 in which head end 22 is inclined. Similarly, the lower position is useful in a variety of situations including the situation shown in FIG. 4 in which head end 22 is lowered and it is desired to transfer patient 20 from a first bed 18*a* to an adjacent bed 18*b*. An example of height adjuster 140 comprises a pulley coupled to a pulley mount for mounting the pulley in a selected one of the plurality of vertically-spaced positions. A linear actuator, a motorized jack screw, or any other suitable driver may be used to change the position of pulley. User controls (not shown) may be used to control operation of the driver pulley.

Figure 5:
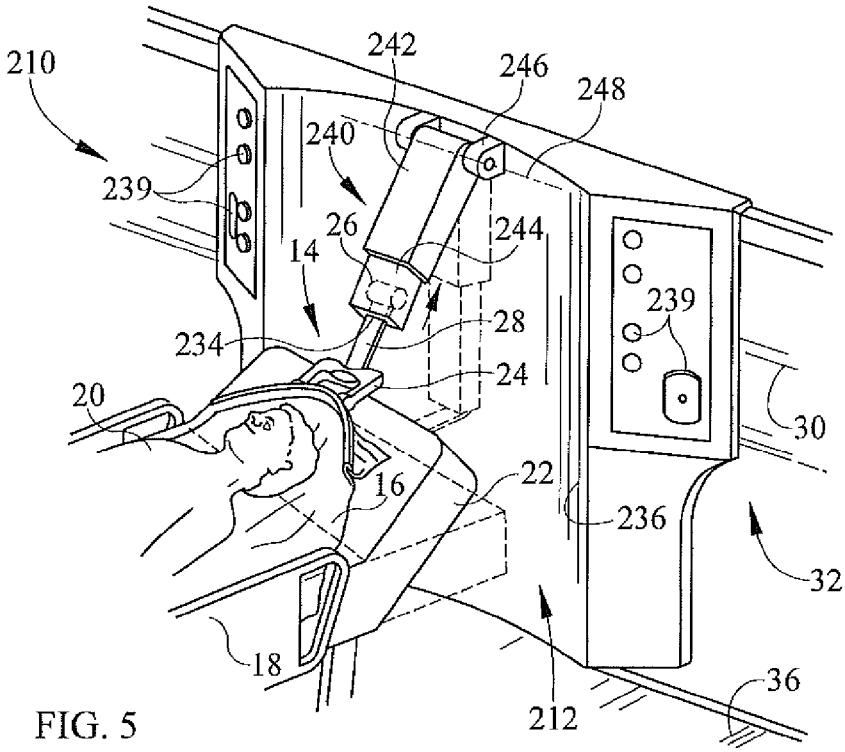
FIGS. 5 and 6 are perspective views showing the patient support device coupled to a device mount configured, for example, as a telescopic arm assembly coupled to a headwall for pivotable movement of the telescopic arm assembly and the power unit relative to the headwall.
Figure 6:
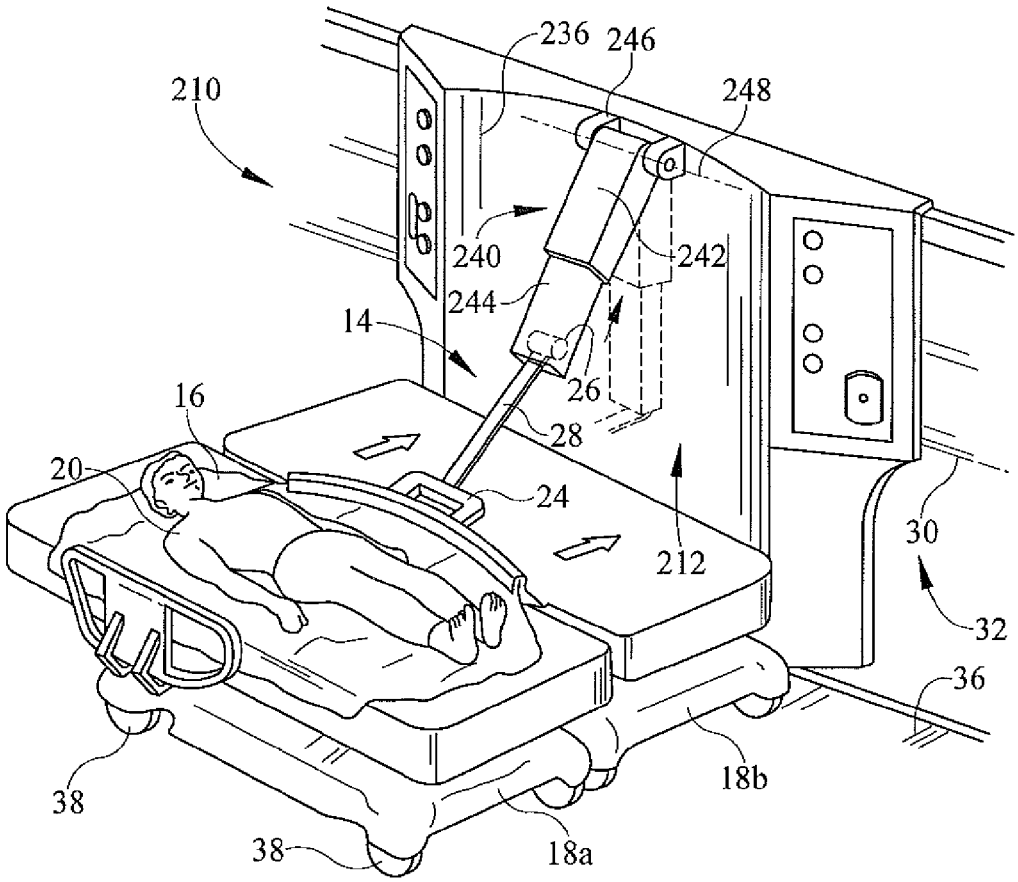

Referring to FIGS. 5 and 6, an apparatus 210 comprises an architectural system 212 and patient adjustment device 14 which is coupled to system 212. System 212 comprises a headwall 236 and a device mount 240. Headwall 236 is coupled to wall 30 and is configured to provide a variety of services (e.g., medical air, oxygen, electrical power, data communication) from outlets 239 for care of patient 20. Device mount 240 is coupled to headwall 236 and power unit 26 is coupled to device mount 238.

Illustratively, device mount 240 is configured as a telescopic pivot arm assembly comprising proximal and distal portions 242, 244 positioned in telescoping relation to one another. Proximal portion 242 is coupled to an arm mount 246 of headwall 236 for pivotable movement of arm assembly 240 relative to headwall 236 about a horizontal pivot axis 248. Power unit 26 is coupled to distal portion 244 to pivot with arm assembly 240 about axis 248 and to move with distal portion 244 toward and away from proximal portion 242 upon telescoping movement of distal portion 244 relative to proximal portion 242. Tether 28 extends from power unit 26 through an aperture 234 formed in distal portion 244 to gripper 24. Pivotable movement of arm assembly 240 and telescoping movement between portions 242, 244 facilitate adjustment of the height at which tether 28 exits distal portion 244 through aperture 234. Arm assembly 240 thus acts as a tether height adjuster. Such movement of arm assembly 240 further facilitates use of patient adjustment device 14 to move patient 20 toward head end 22, as shown, for example, in FIG. 5, and to move patient 20 from bed 18*a* to bed 18*b*, as shown, for example, in FIG. 6. Pivoting movement of arm assembly 240 may pull on tether 28 alone or in combination with operation of power unit 26 and movement of distal portion 244 relative to proximal portion 242.

An arm pivoter (not shown) may be used to pivot arm assembly 240 about pivot axis 248. The arm pivoter may include, but is not limited to, a hydraulic cylinder, a linear actuator, a motor and linkage, and/or a pneumatic cylinder. In some embodiments, arm assembly 240 pivots manually and locks in place via a suitable locking mechanism. User controls (not shown) may be used to control operation of the arm pivoter.

An arm driver (not shown) may be used to move distal portion 244 toward and away from proximal portion 242. The arm driver may include, but is not limited to, a hydraulic cylinder, a linear actuator, a motor and linkage, and/or a pneumatic cylinder. User controls (not shown) may be used to control operation of the arm driver.

Figure 7:
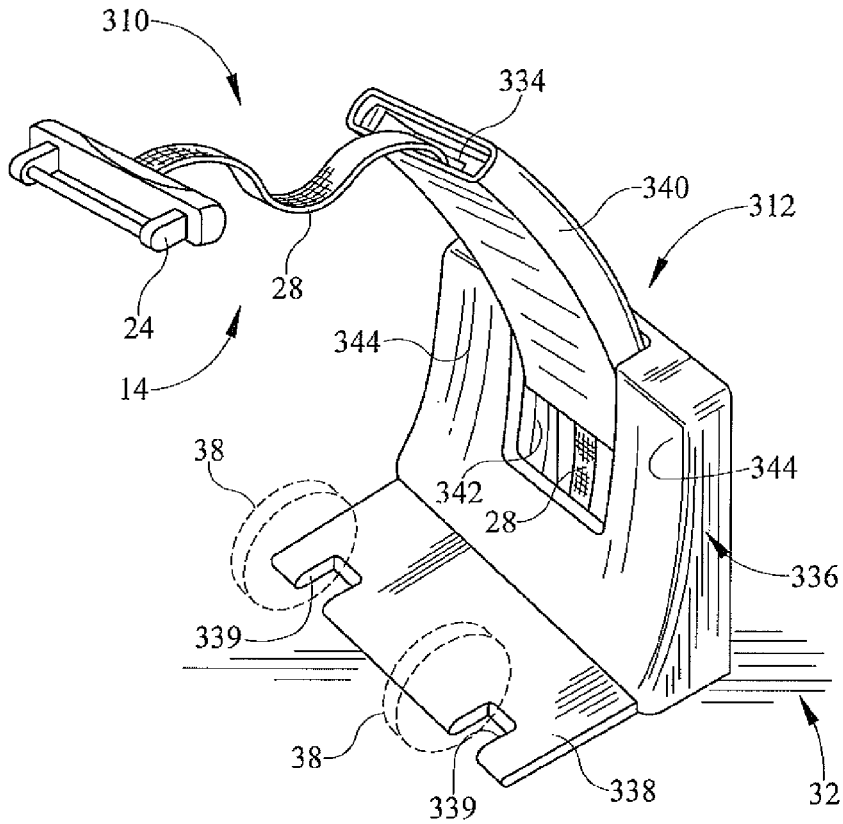
FIG. 7 is a perspective view showing the patient adjustment device coupled to a bed locator which is coupled to a floor.
Figure 8:
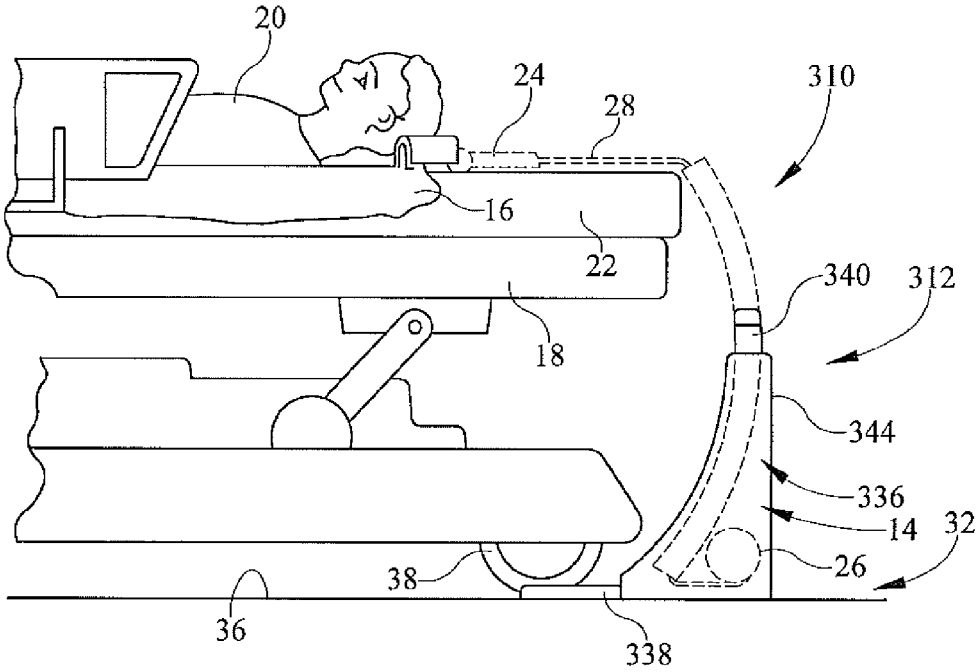
FIG. 8 is a side elevational view showing the patient adjustment device coupled to the bed locator of FIG. 7.

Referring to FIGS. 7 and 8, an apparatus 310 comprises an architectural system 312 and patient adjustment device 14 which is coupled to system 312. System 312 acts as a bed locator and comprises a base 336 coupled to floor 36, a bed locator plate 338 coupled to and extending from base 336 along floor 36 to receive casters 38 of bed 18 in notches 339 formed in plate 338, and a tether height adjuster 340. Power unit 26 is coupled to base 336. Tether 28 extends from power unit 26 through height adjuster 340 and exits height adjuster 340 through an aperture 334 formed in height adjuster 340 to extend to gripper 24.

Height adjuster 340 is configured to adjust the height at which tether 28 exits aperture 334 to thereby accommodate the height of bed 18. To do so, height adjuster 340 is coupled to base 336 for vertical movement relative thereto to assume a selected one of a plurality of vertically-spaced positions such as an upper position shown, for example, in FIG. 7 and a lower position, shown, for example, in FIG. 8. An example of height adjuster 340 is configured as a curved arm that fits in a curved track 342 of base 336 for vertical movement along track 342. A pair of spaced-apart arms 344 included in base 336 provides track 342. Curvature of the curved arm 340 and track 344 accommodates arcuate movement of an upper frame of bed 18 as the upper frame is raised and lowered. An arm driver (not shown) may be used to move curved arm 340 along track 344. User controls (not shown) may be used to control operation of the arm driver.

Figure 9:
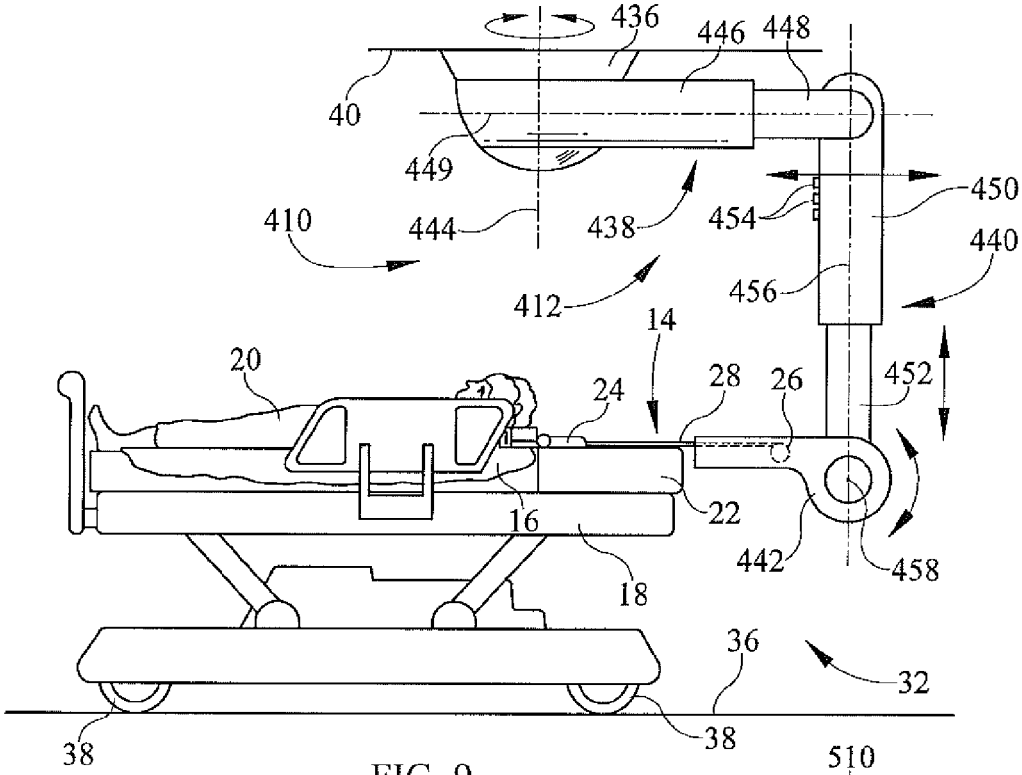
FIG. 9 is a side elevational view showing the patient adjustment device coupled to an articulating column system which is coupled to a ceiling.

Referring to FIG. 9, an apparatus 410 comprises an architectural system 412 and patient adjustment device 14 which is coupled to system 412. System 412 is configured as an articulating column system coupled to a ceiling 40 of room 32.

System 412 comprises an arm mount 436 coupled to ceiling 40, a horizontal first telescopic arm assembly 438, a vertical second telescopic arm assembly 440, and a device mount 442. First telescopic arm assembly 438 is coupled to arm mount 436 for pivotable movement about a vertical pivot axis 444 and comprises proximal and distal portions 446, 448. Distal portion 448 is arranged to telescope relative to proximal portion 446 along a horizontal longitudinal axis 449 of arm assembly 438. A first arm assembly driver (not shown) may be used to move distal portion 448 relative to proximal portion 446. The first arm assembly driver may include, but is not limited to, a hydraulic cylinder, a linear actuator, a motor and linkage, and/or a pneumatic cylinder. User controls (not shown) may be used to control operation of the first aim assembly driver.

Second telescopic arm assembly 440 is suspended from distal portion 448 and comprises proximal and distal portions 450, 452. Proximal portion 450 is configured as a column comprising outlets 454 to provide a variety of services (e.g., medical gas, oxygen, electrical power, data communication) for care of patient 20. Distal portion 452 is arranged to telescope relative to proximal portion 450 along a vertical longitudinal axis 456 of arm assembly 440. A second arm assembly driver (not shown) may be used to move distal portion 452 relative to proximal portion 450. The second arm assembly driver may include, but is not limited to, a hydraulic cylinder, a linear actuator, a motor and linkage, and/or a pneumatic cylinder. User controls (not shown) may be used to control operation of the second arm assembly driver.

Device mount 442 is coupled to distal portion 452 of second telescopic arm assembly 440. Power unit 26 is coupled to device mount 442 for movement therewith. As such, patient adjustment device 14 is suspended above floor 36 and can be moved horizontally and vertically above floor 36. It can be moved horizontally upon pivotable movement of arm assembly 438 about axis 444 and/or telescoping movement of distal portion 448 relative to proximal portion 446 along axis 449. It can be moved vertically upon telescoping movement of distal portion 452 relative to proximal portion 450 along axis 456. It is within the scope of this disclosure for device mount 442 to be pivotable by a mount pivoter (not shown) about a horizontal axis 458 to further effect horizontal and vertical movement of patient adjustment device 14. The mount pivoter may include, but is not limited to, a hydraulic cylinder, a linear actuator, a motor and linkage, and/or a pneumatic cylinder. Second telescopic arm assembly and/or device mount 442 can thus act as a tether height adjuster to adjust the height at which tether 28 exits device mount 442.

Figure 10:
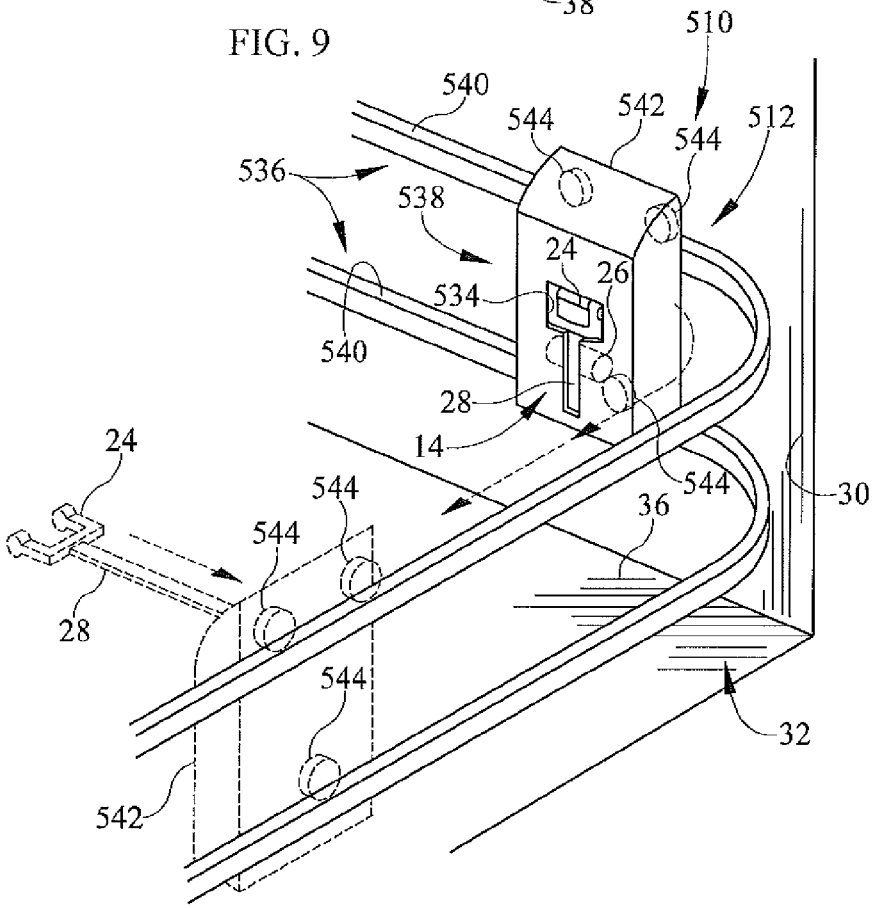
FIG. 10 is a perspective view showing the patient adjustment device coupled to a device mount which is movable horizontally along a pair of rails coupled to a room wall.

Referring to FIG. 10, an apparatus 510 comprises an architectural system 512 and patient adjustment device 14 which is coupled to system 512. System 512 is configured for movement of patient adjustment device 14 horizontally along one or more walls 30 of room 32 to accommodate positioning of bed 18 at different locations in room 32.

System 512 comprises a mount support 536 coupled to wall(s) 30 and a device mount 538 coupled to support 536 for horizontal movement along support 536. Illustratively, mount support 536 includes a pair of spaced-apart parallel rails 540 coupled to walls(s) 30 and device mount 538 comprises a housing 542 containing power unit 26 and a plurality (e.g., three) of rollers 544 that roll on rails 540 for horizontal movement of housing 542 and patient adjustment device 14. Housing 542 is formed to include an aperture 534 through which tether 28 is arranged to extend during use of device 14 and that receives gripper 24 when tether 28 is wound up by power unit 26 during storage of device 14. A mount driver (not shown) may be used to move mount 538 along rails 540. The mount driver may include, but is not limited to, a hydraulic cylinder, a linear actuator, a motor and linkage, and/or a pneumatic cylinder. User controls (not shown) may be used to control operation of the mount driver.

Rollers 544 may have V-shaped or U-shaped grooves about their perimeter and rails 540 may have V-shaped or U-shaped upper surfaces received in the grooves of rollers 544 to retain device 14 on rails 540.

Rollers 544 are supported relative to housing 542 so as to track around the corner formed by rails 540. In one embodiment, rollers 544 are supported on axles that are pivotable about vertical axes.

The device 14 of system 514 may include a lock to lock device 14 in a desired position along rails 540. Such a lock may include a clutch, brake, or retractable pin that engages one or more of rails 540.

Figure 11:
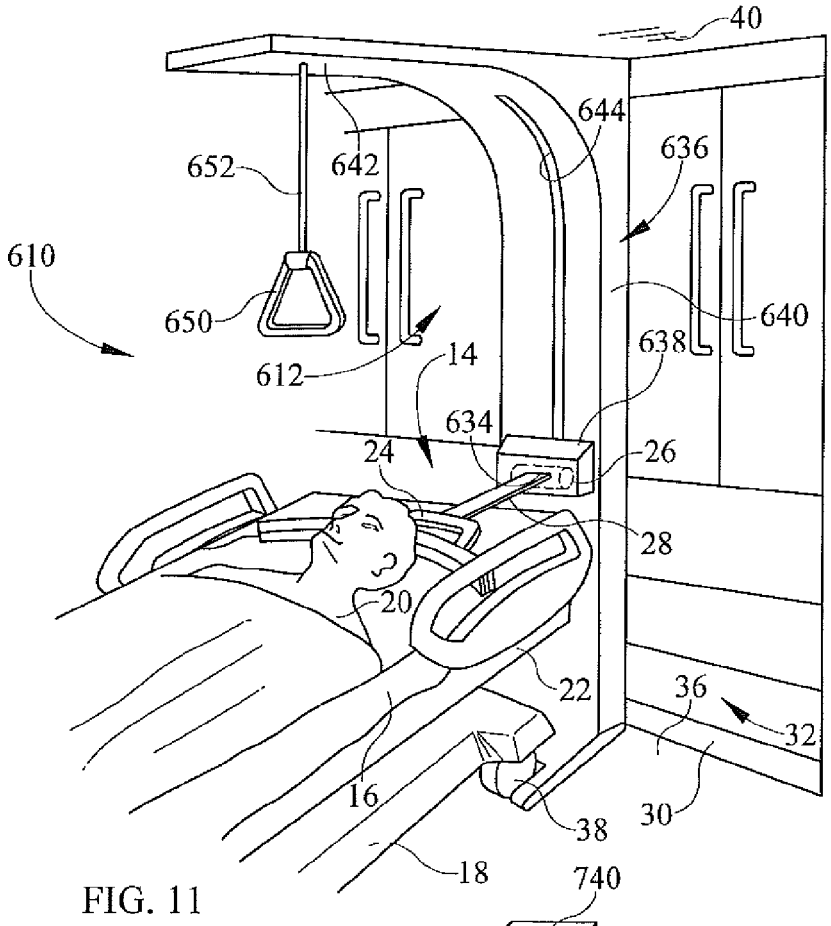
FIG. 11 is a perspective view showing the patient adjustment device coupled to device mount which is movable along a slot formed in a mount support extending along a room wall and ceiling.

Referring to FIG. 11, an apparatus 610 comprises an architectural system 612 and patient adjustment device 14 which is coupled to system 612. System 612 is configured for movement of patient adjustment device 14 vertically along wall 30 and somewhat horizontally along ceiling 40.

System 612 comprises a mount support 636 coupled to wall 30 and ceiling 40 and a device mount 638 coupled to support 636 for movement along support 636. Mount support 636 comprises a wall portion 640 coupled to wall 30, a ceiling portion 642 coupled to ceiling 40, and a slot 644 formed in wall portion 640 and ceiling portion 642 to extend vertically along wall portion 640 and extend along ceiling portion 642 in a direction having a horizontal component. Device mount 638 is coupled to support 636 for movement along slot 644. Power unit 26 is coupled to and positioned in device mount 638 for movement therewith. Tether 28 extends from power unit 26 through an aperture 634 formed in device mount 638 to gripper 24. The height at which tether 28 exits aperture 634 can be adjusted upon movement of device mount 638 along slot 644. Device mount 638 is thus configured to act as a tether height adjuster. A mount driver (not shown) may be used to move mount 638 along slot 644. The mount driver may include, but is not limited to, a hydraulic cylinder, a linear actuator, a motor and linkage, and/or a pneumatic cylinder. User controls (not shown) may be used to control operation of the mount driver.

A trapeze handle 650 is supported by a cable 652 hanging downwardly from ceiling portion 642. During repositioning by device 14 or at other times, the patient may grip handle 650 to help reposition himself/herself.

Figure 12:
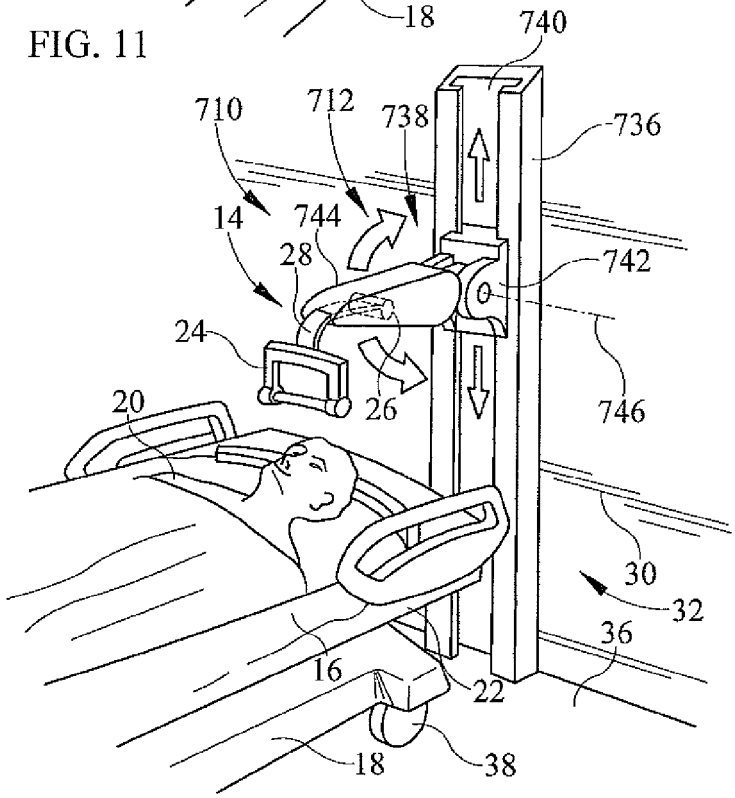
FIG. 12 is a perspective view showing the patient adjustment device coupled to a pivot arm carried by a track follower arranged for movement along a vertical track.

Referring to FIG. 12, an apparatus 710 comprises an architectural system 712 and patient adjustment device 14 which is coupled to system 712. System 712 is configured for vertical movement of patient adjustment device 14 along wall 30.

System 712 comprises a mount support 736 coupled to wall 30 and a device mount 738 coupled to support 736 for vertical movement along support 736. Support 736 comprises a vertical track 740. Device mount 738 comprises a track follower 742 coupled to vertical track 740 for vertical movement along track 740 and a pivot arm 744 coupled to track follower 742 for pivotable movement relative to track follower 742 about a pivot axis 746. Power unit 26 is coupled to and positioned in pivot arm 744 for movement therewith. Tether 28 extends from power unit 26 through an aperture 734 formed in pivot arm 744. The height at which tether 28 exits aperture 734 can be adjusted upon movement of track follower 742 along track 740 and upon pivotable movement of pivot arm 744 about pivot axis 746. Device mount 738 is thus configured to act as a tether height adjuster. An arm pivoter (not shown) such as, for example, a linear actuator may be used to pivot arm 744 about pivot axis 746. A mount driver (not shown) may be used to move mount 738 along track 740. The mount driver may include, but is not limited to, a hydraulic cylinder, a linear actuator, a motor and linkage, and/or a pneumatic cylinder. User controls (not shown) may be used to control operation of the arm pivoter and the mount driver.

Figure 13:
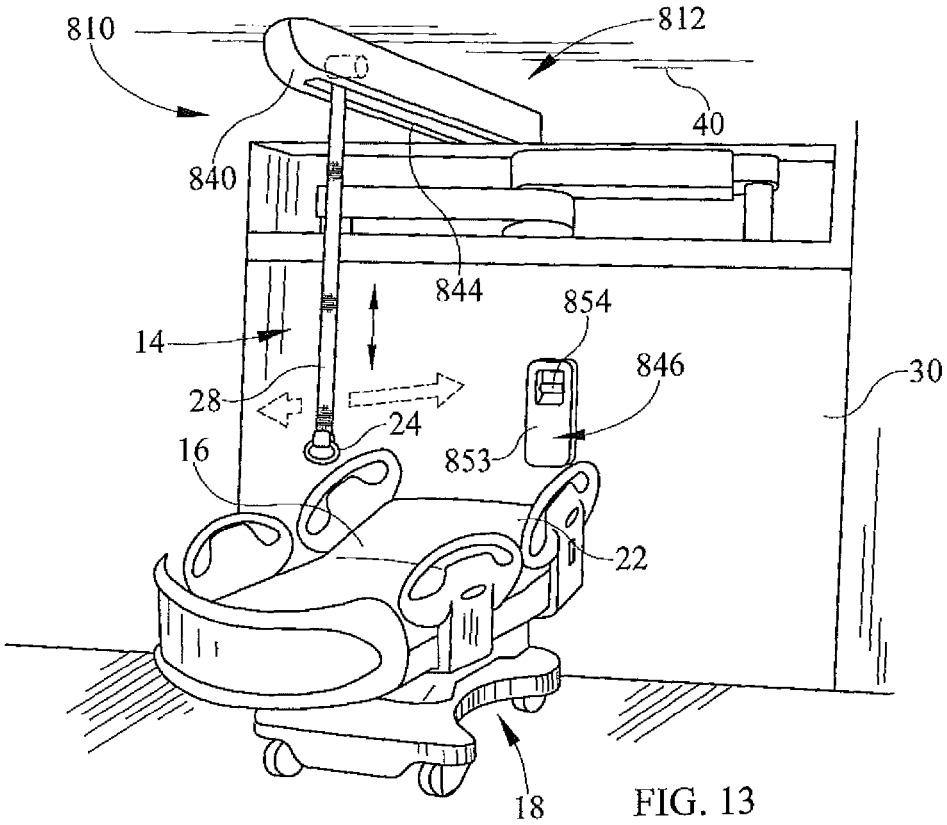
FIGS. 13 and 14 are perspective views showing the patient adjustment device coupled to a ceiling-mounted architectural system.
Figure 14:
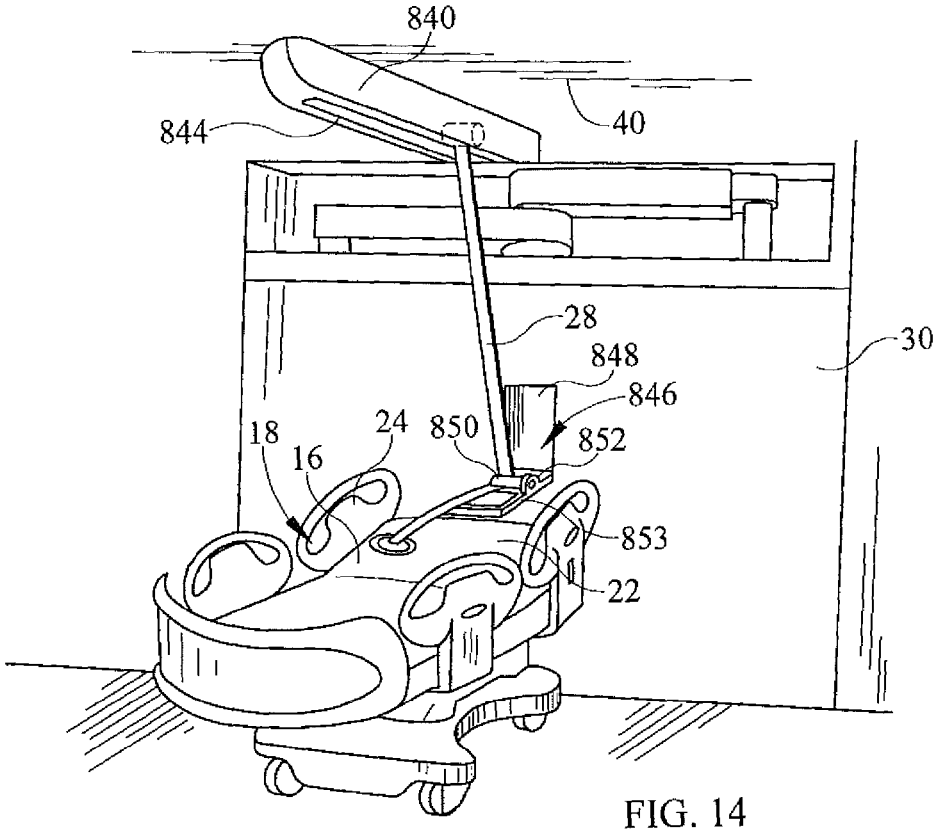
Figure 15:
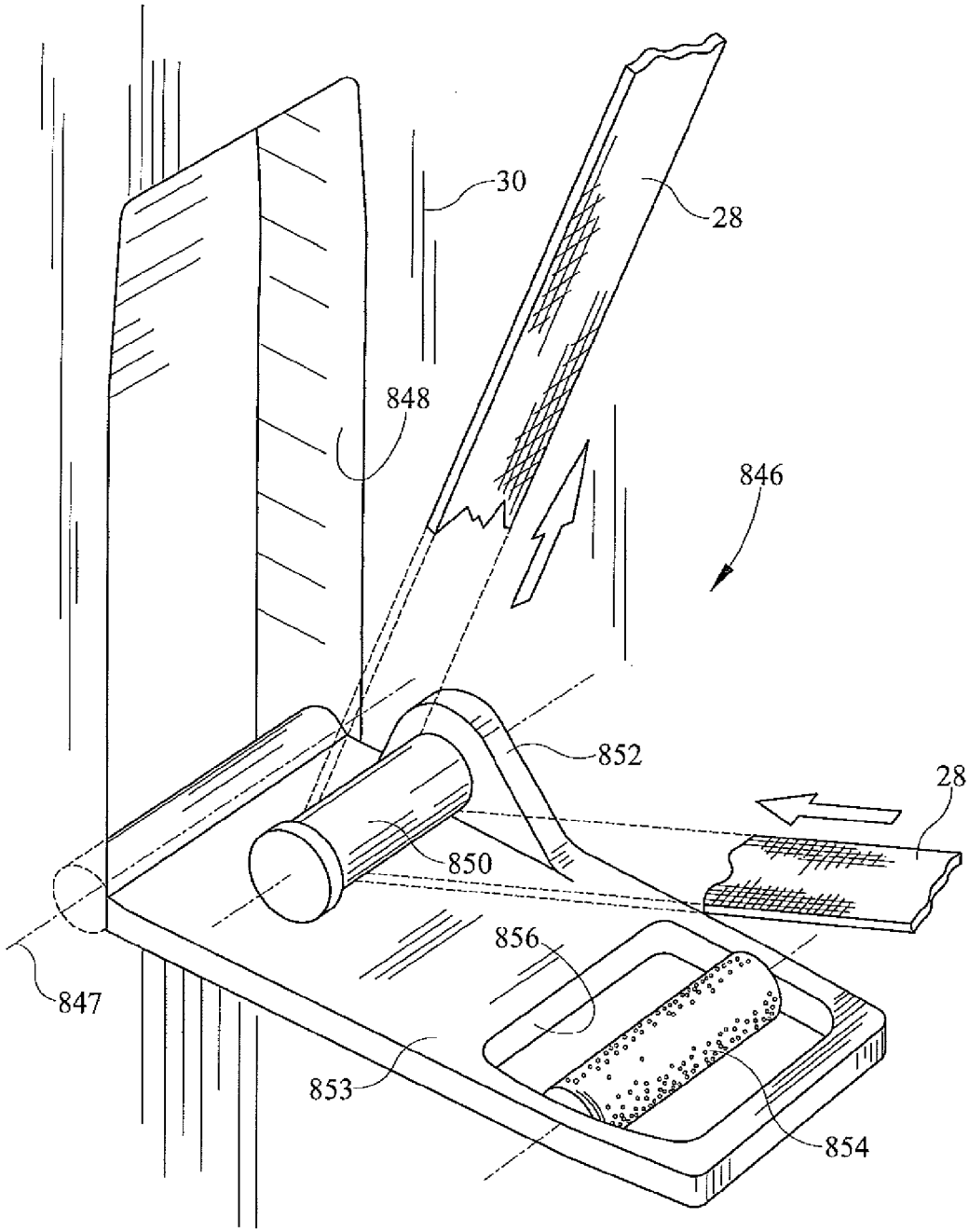
FIG. 15 is a perspective view showing a wall-mounted tether direction adjuster for adjusting the direction of extension of tether.

Referring to FIGS. 13-15, an apparatus 810 comprises an architectural system 812 and patient adjustment device 14 which is coupled to system 812. System 812 is configured for horizontal movement of patient adjustment device 14 along ceiling 40.

System 812 comprises a horizontal track 840. Power unit 26 is coupled to track 840 for horizontal movement back-and-forth along track 840. In some embodiments, system 812 further comprises a unit mover (not shown) and user controls (not shown) coupled to the unit mover to cause the unit mover to move power unit 26 along track 840. In some embodiments, power unit 26 is movable manually along track 840 and can be locked in a plurality of positions along track 840. Tether 28 depends from power unit 26 through a slot 844 formed in track 840.

Device 14 may be used with or without a tether direction adjuster 846 included in system 812. When device 14 is used without adjuster 846, tether 28 hangs vertically from power unit 26. In such a case, device 14 may be used for a variety of purposes such as, for example, to lift patient 20, to support a variety of devices (e.g., trapeze handle, IV bags, traction equipment, patient pendant, bed table), and the like. When device 14 is used with adjuster 846, tether 28 is routed through adjuster 846 so that tether 28 can pull coupler 24 and thus patient 20 on receiver 16 in a generally horizontal direction to reposition patient 20 toward head end 22.

Tether direction adjuster 846 is coupled to wall 30 for pivotable movement about an axis 847 between an out-of-theway, storage position shown, for example, in FIG. 13 and a direction adjustment position shown, for example, in FIGS. 14 and 15. In the storage position, adjuster 846 is received in a recess 848 formed in wall 30. In the direction adjustment position, adjuster 846 extends away from recess 848 to allow tether 28 to be routed around a pulley 850 coupled to a pulley mount 852 supported on a support plate 853. A person can move adjuster 846 between the storage position and the direction adjustment position by use of a handle 854 coupled to support plate 853 and located in an aperture 856 formed in support plate 853. An adjuster lock (not shown) may be used to lock adjuster 846 in or both of the storage position and the direction adjustment position.

Figure 16:
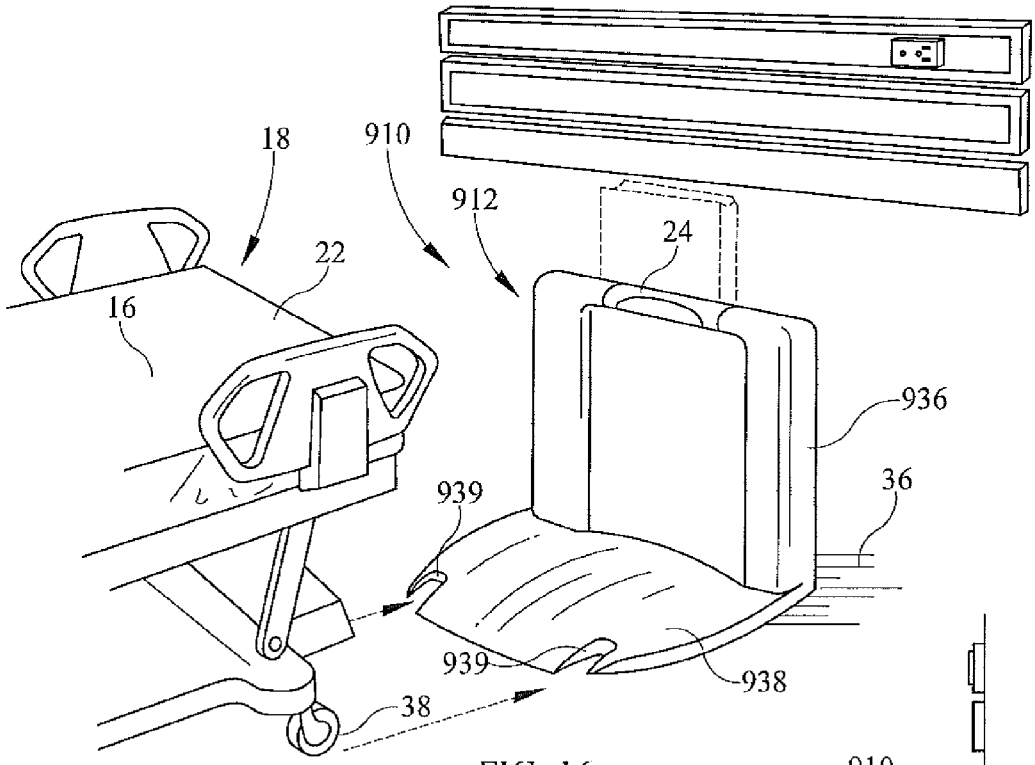
FIG. 16 is a perspective view showing the patient adjustment device coupled to another bed locator.
Figure 17:
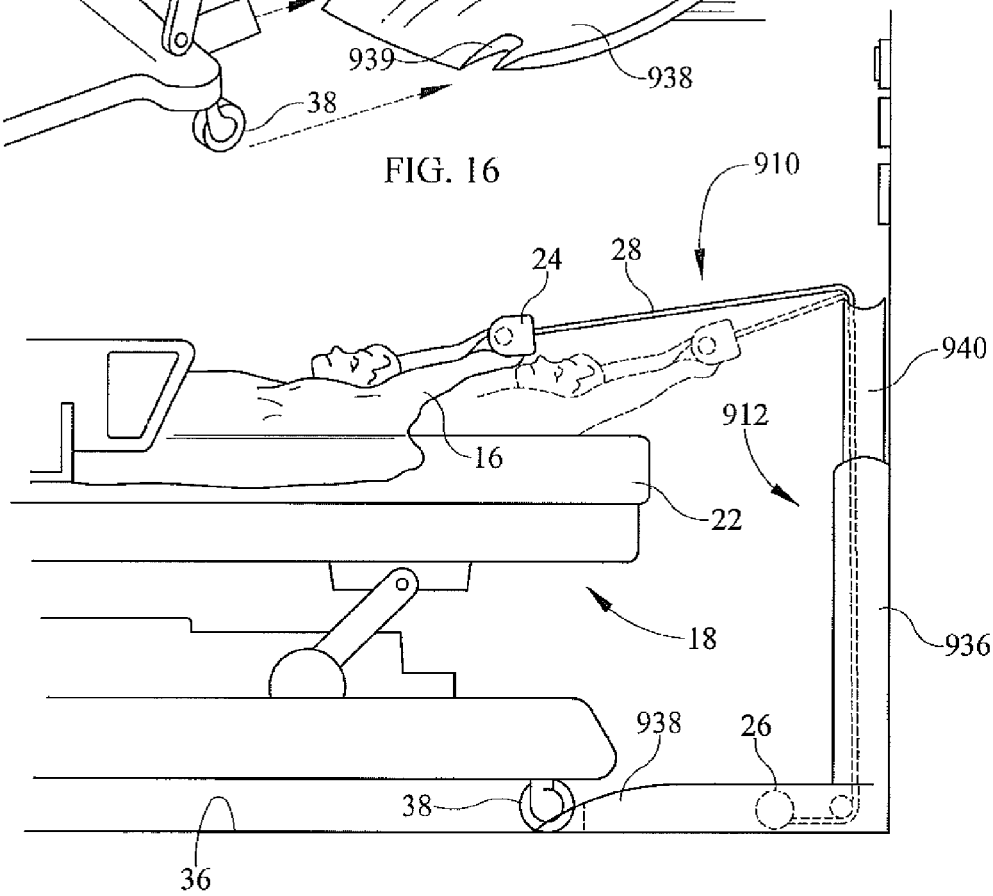
FIG. 17 is a side elevational view showing the patient adjustment device coupled to the bed locator of FIG. 16.

Referring to FIGS. 16 and 17, an apparatus 910 comprises an architectural system 912 and patient adjustment device 14 which is coupled to system 912. System 912 acts as a bed locator and comprises a base 936 coupled to floor 36, a bed locator plate 938 coupled to and extending from base 936, along floor 36 to receive casters 38 of bed 18 in notches 939 formed in plate 938, and a tether height adjuster 940. Power unit 26 is coupled to base 936. It is within the scope of this disclosure for power unit 26 to be coupled to height adjuster 940. Tether 28 extends from power unit 26 through height adjuster 940 and exits height adjuster 940 through an aperture formed in height adjuster 940 to extend to gripper 24.

Height adjuster 940 is configured to adjust the height at which tether 28 exits the aperture formed in adjuster 940 to thereby accommodate the height of bed 18. To do so, height adjuster 940 is coupled to base 936 for telescopic vertical movement relative thereto to assume a selected one of a plurality of vertically-spaced positions such as a lower position shown, for example, in FIG. 16 and an upper position, shown, for example, in FIG. 17. An example of height adjuster 940 is configured as a vertical arm that fits in base 936 for telescopic vertical movement along base 936. An aim driver (not shown) may be used to move arm 940 along base 936. User controls (not shown) may be used to control operation of the arm driver.

Figure 18:
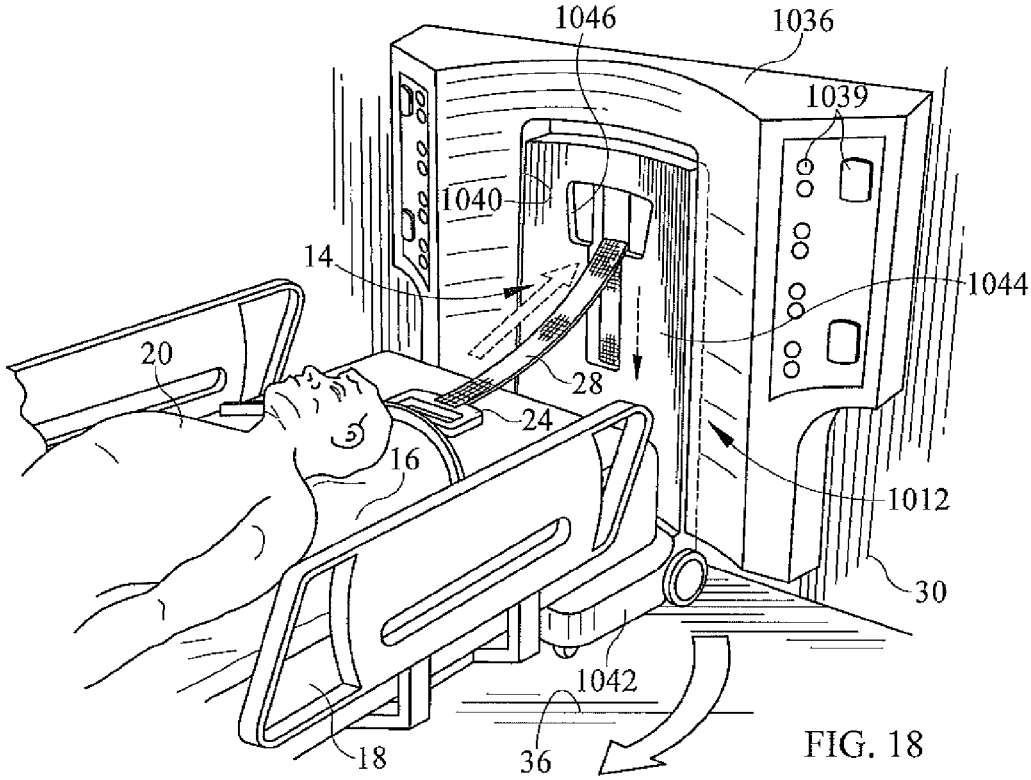
FIGS. 18 and 19 are perspective views showing the patient adjustment device coupled to an architectural system configured, for example, as a cart positionable in and out of a cavity formed in a headwall.
Figure 19:
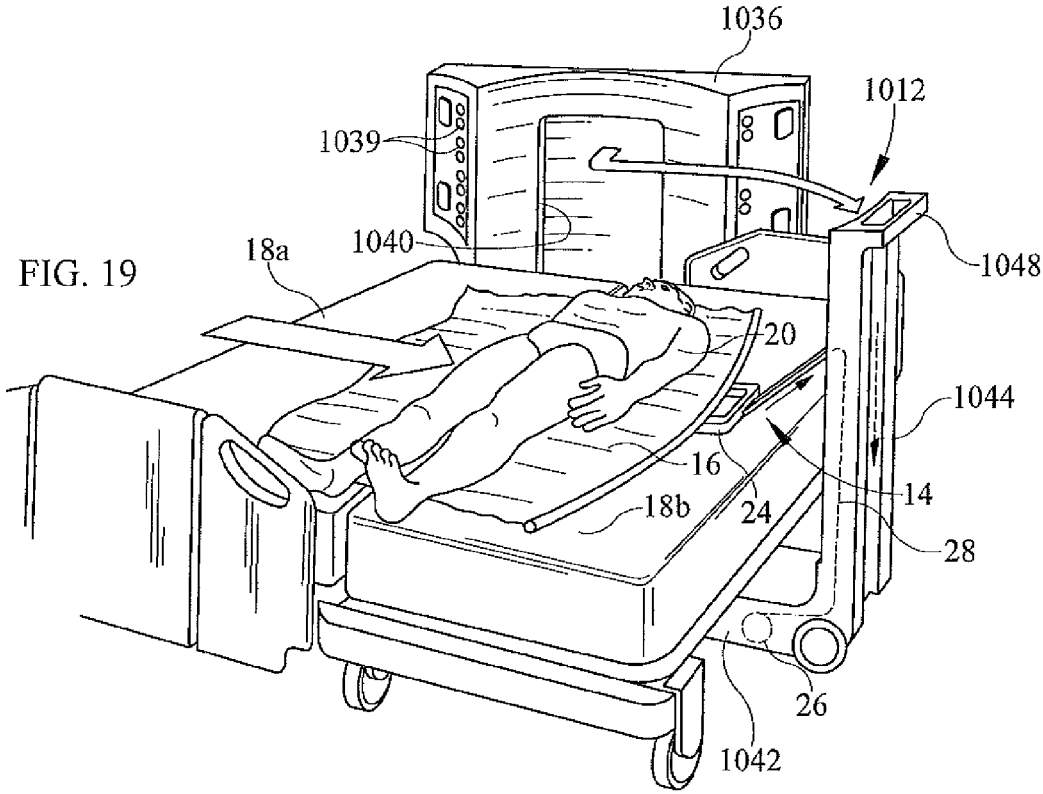

Referring to FIGS. 18 and 19, an apparatus 1012 comprises a headwall 1036, an architectural system 1012, and patient adjustment device 14 coupled to system 1012. Headwall 1036 is coupled to wall 30 and is configured to provide a variety of services (e.g., medical air, oxygen, electrical power, data communication) from outlets 1039 for care of patient 20. Headwall 1036 is formed to include a cavity 1040. System 1012 is positionable in cavity 1040 for repositioning patient 20 on bed 18, as shown in FIG. 18, and is positionable out of cavity 1040 for surface-to-surface transfer of patient 20 between beds 18*a* and 18*b*, as shown in FIG. 19.

System 1012 is configured, for example, as a generally L-shaped cart. As such, system 1012 comprises a generally horizontal wheeled base 1042 and a generally vertical portion 1044 extending upwardly therefrom. Vertical portion 1044 is received in cavity 1040 when system 1012 is positioned therein. Illustratively, power unit 26 is coupled to base 1042. In other examples, power unit 26 may be coupled to other locations of system 1012 such as vertical portion 1044. Tether 28 extends from power unit 26 through vertical portion 1044 and an aperture 1046 formed in vertical portion 1044 to gripper 24. A handle 1048 for use in maneuvering system 1012 is coupled to an upper portion of vertical portion 1044.

The user controls disclosed herein may be mounted in a variety of locations such as, for example, anywhere on the respective architectural system 12, 112, 212, 312, 412, 512, 612, 712, 812, 912, 1012, wall 30, gripper 24, and/or any other suitable location. The user controls may communicate with the respective device controlled thereby wirelessly or through a wired connection.

Although certain illustrative embodiments have been described in detail above, variations and modifications exist within the scope and spirit of this disclosure as described and as defined in the following claims.

The invention claimed is:

1. A person positioning apparatus, comprising:

a person-support positioning device configured to position a person-support apparatus in an area; and a person adjustment device coupled to the person-support positioning device, the person adjustment device being configured to pull on a person receiver positioned on the person-support apparatus to move a person positioned on the person receiver with the person receiver relative to the person-support apparatus to adjust the position of the person with respect to the person-support apparatus.

2. The person positioning apparatus of claim 1, wherein the person-support positioning device includes at least one slot configured to receive at least one castor of the person-support apparatus.

3. The person positioning apparatus of claim 1 further comprising a motor configured to move the person adjustment device, wherein the motor is positioned within the person-support positioning device.

4. The person positioning apparatus of claim 3, wherein a tether extends between the motor and the person receiver, the motor being configured to at least one of extend and retract the tether to move the person receiver.

5. The person positioning apparatus of claim 4, wherein a tether guide is positioned within the person-support positioning device and is configured to change the orientation of the tether with respect to the person-support positioning device from a first orientation to a second orientation.

6. The person positioning apparatus of claim 4, wherein the person-support positioning device includes a base and a back portion extending substantially vertically from the base, wherein the motor is positioned in the base and the tether extends through an opening in the back portion.

7. The person positioning apparatus of claim 1, wherein the person-support positioning device includes a base and a back portion extending substantially vertically from the base, the back portion includes an extension configured to be positionable within the back portion and extendable substantially vertically through an opening in the back portion.

8. A person positioning apparatus, comprising:

a base with a locator configured to engage a portion of a person-support apparatus to orient the person-support apparatus with respect to the base;

a back portion extending from the base, the back portion including an extension configured to be positionable within the back portion and extendable from the back portion; and a person adjustment assembly configured to extend through the back portion and adjust the position of a person supported on the person-support apparatus with respect to the person-support apparatus.

9. The person positioning apparatus of claim 8, wherein the person adjustment assembly includes a tether configured to extend from an opening in the extension.

10. The person positioning apparatus of claim 8 further comprising a motor positioned within the base, the motor being configured to extend and retract the person adjustment assembly to adjust the position of a person supported on the person-support apparatus with respect to the person-support apparatus.

11. The person positioning apparatus of claim 10, wherein the person adjustment assembly includes a tether and a person adjustment device, the tether being configured to extend between the motor and the person adjustment device, the motor being configured to at least one of extend and retract the tether to move the person adjustment device.

12. The person positioning apparatus of claim 8, wherein the person adjustment assembly includes a grip configured to be gripped by a person.

13. The person positioning apparatus of claim 8, wherein the person adjustment assembly includes a coupling portion configured to couple to a receiver movably supported on the person-support apparatus, a person being positioned on the receiver.

14. The person positioning apparatus of claim 8, wherein the base includes at least one slot configured to receive at least one castor of the person-support apparatus.

15. A person positioning apparatus, comprising:

a person-support locating device configured to locate a person-support apparatus with respect to the person-support locating device; and a person adjusting device configured to adjust a position of a person supported on a person-support apparatus with respect to the person-support apparatus, the person adjusting device including a tether with a free end and at least one of an extending and retracting device configured to at least one of extend and retract the tether to move the person with respect to the person-support apparatus.

16. The person positioning apparatus of claim 15, wherein the person-support locating device includes at least one slot configured to receive at least one castor of the person-support apparatus.

17. The person positioning apparatus of claim 15, wherein the tether is configured to extend from an opening in the person-support locating device.

18. The person positioning apparatus of claim 15, wherein a tether guide is positioned within the person-support locating device and is configured to change the orientation of the tether with respect to the person-support locating device from a first orientation to a second orientation as the tether passes the tether guide.

19. The person positioning apparatus of claim 15, wherein the person-support locating device includes a base and a back portion extending substantially vertically from the base, wherein the at least one of the extending and retracting device is positioned in the base and the tether extends through an opening in the back portion.

20. The person positioning apparatus of claim 15, wherein the person-support locating device includes a base and a back portion extending substantially vertically from the base, the back portion including an extension configured to be positionable within the back portion and extendable substantially vertically through an opening in the back portion.

* * * * *